US009719659B2

(12) United States Patent
Ju et al.

(10) Patent No.: US 9,719,659 B2
(45) Date of Patent: Aug. 1, 2017

(54) LAMP

(71) Applicant: RADIANT OPTO-ELECTRONICS CORPORATION, Kaohsiung (TW)

(72) Inventors: Chih-Hung Ju, Kaohsiung (TW); Guo-Hao Huang, Kaohsiung (TW); Kun-Feng Chen, Kaohsiung (TW); Pen-Jan Wang, Kaohsiung (TW)

(73) Assignee: RADIANT OPTO-ELECTRONICS CORPORATION, Kaohsiung (TW)

( * ) Notice: Subject to any disclaimer, the term of this patent is extended or adjusted under 35 U.S.C. 154(b) by 146 days.

(21) Appl. No.: 14/668,168

(22) Filed: Mar. 25, 2015

(65) Prior Publication Data

US 2015/0276176 A1 Oct. 1, 2015

(30) Foreign Application Priority Data

Mar. 31, 2014 (TW) ..... 103111975 A

(51) Int. Cl.
*F21V 9/08* (2006.01)
*F21V 5/04* (2006.01)
(Continued)

(52) U.S. Cl.
CPC ..... *F21V 9/08* (2013.01); *F21K 9/60* (2016.08); *F21K 9/69* (2016.08); *F21V 5/04* (2013.01);
(Continued)

(58) Field of Classification Search
CPC ..... F21V 9/08; F21V 9/60; F21V 9/00; F21V 5/04; F21V 17/002; F21V 17/02;
(Continued)

(56) References Cited

U.S. PATENT DOCUMENTS 7,222,988 B2 * 5/2007 Gober ..... G09F 21/12 362/257
7,988,322 B2 8/2011 Zheng
(Continued)

FOREIGN PATENT DOCUMENTS

CN 201289044 8/2009
CN 201696900 1/2011
(Continued)

OTHER PUBLICATIONS

Chinese Search Resort issued in App. No. 2014101894054 dated Aug. 10, 2016 (w/ translation).
(Continued)

*Primary Examiner* — Mary Ellen Bowman
(74) *Attorney, Agent, or Firm* — Nixon & Vanderhye P.C.

(57) ABSTRACT

A lamp includes a base, a light emitting module mounted to the base, a lens member and a decorating unit. The lens member has a light input surface, a light output surface disposed in front of and spaced apart from the light input surface along an axis, and a through hole extending through the light input surface and the light output surface. Light emitted from the light emitting module enters the lens member through the light input surface and exits the lens member through the light output surface. The decorating unit is detachable and is optically disposed for decorating the lamp or for changing at least one of a wavelength, an output angle, a light field and so forth of the light passing through the lens member.

26 Claims, 10 Drawing Sheets

(51) Int. Cl.

| | |
|---|---|
| ***F21V 17/00*** | (2006.01) |
| ***F21V 17/02*** | (2006.01) |
| ***F21V 17/10*** | (2006.01) |
| ***F21K 9/60*** | (2016.01) |
| ***F21K 9/69*** | (2016.01) |
| *F21Y 103/33* | (2016.01) |
| *F21Y 115/10* | (2016.01) |

(52) U.S. Cl.
CPC ..... *F21V 17/002* (2013.01); *F21V 17/02* (2013.01); *F21V 17/101* (2013.01); *F21Y 2103/33* (2016.08); *F21Y 2115/10* (2016.08)

(58) Field of Classification Search
CPC .. F21V 17/10; F21Y 2103/33; F21Y 2115/10; F21Y 2101/00
See application file for complete search history.

(56) References Cited

U.S. PATENT DOCUMENTS

| | | | | |
|---|---|---|---|---|
| 8,487,518 | B2 * | 7/2013 | Johnston | G02B 6/0085 313/11 |
| 8,957,597 | B2 * | 2/2015 | Lin | H05B 33/0803 315/291 |
| 2006/0007692 | A1 * | 1/2006 | Hsien | F21V 5/008 362/382 |
| 2010/0073960 | A1 * | 3/2010 | Yang | A47G 19/2227 362/612 |
| 2010/0085737 | A1 * | 4/2010 | Yang | F21S 6/001 362/101 |
| 2011/0291560 | A1 | 12/2011 | Wang et al. | |
| 2011/0309735 | A1 * | 12/2011 | Parker | F21V 3/02 313/46 |
| 2013/0038195 | A1 * | 2/2013 | Petroski | F21V 29/22 313/35 |
| 2013/0265754 | A1 | 10/2013 | Tsai et al. | |
| 2014/0092580 | A1 * | 4/2014 | McCollum | F21V 29/77 362/84 |
| 2014/0167593 | A1 | 6/2014 | Li | |

FOREIGN PATENT DOCUMENTS

| | | |
|---|---|---|
| CN | 102052623 | 5/2011 |
| CN | 202613256 | 12/2012 |
| CN | 203036387 | 3/2013 |
| CN | 103322442 | 9/2013 |
| CN | 203190245 | 9/2013 |
| CN | 203202768 | 9/2013 |
| CN | 103335277 | 10/2013 |
| CN | 103574516 | 2/2014 |
| EP | 2 679 896 | 1/2014 |
| JP | 2010250966 | 11/2010 |
| TW | 454851 | 9/2001 |
| TW | M404310 | 5/2011 |
| TW | M481330 | 7/2014 |
| WO | WO 98/55798 | 12/1998 |
| WO | WO 2013/013514 | 1/2013 |
| WO | WO 2013/023022 | 2/2013 |
| WO | WO 2013/190979 | 12/2013 |
| WO | WO 2014/138163 | 9/2014 |

OTHER PUBLICATIONS

Extended European Search Report issued in EP Application No. 15161610.9 dated Jul. 16, 2015.
Chinese Search Report dated Jun. 23, 2016, issued in Application No. 2015100978752 with partial English translation.
Taiwan Search Report dated Mar. 28, 2016, issued in Application No. 104110024 with partial English translation.
Taiwan Search Report dated Jun. 14, 2016, issued in Application No. 104100779 with partial English translation.
Chinese Search Report dated Dec. 14, 2015, issued in Application No. 2014101894054 filed Mar. 31, 2014 with English translation.
Notice of Allowance issued in U.S. Appl. No. 14/667,700 dated May 5, 2017.

* cited by examiner

LAMP

CROSS-REFERENCE TO RELATED APPLICATION

This application claims priority of Taiwanese Application No. 103111975, filed on Mar. 31, 2014.

FIELD

The invention relates to a lamp, more particularly to a lamp with a detachable decorating unit.

BACKGROUND

Referring to FIG. 1, a conventional lamp 1 includes a fitting seat 11, a plurality of LEDs 12 connected to the fitting seat 11, and a plurality of lenses 13 which correspond respectively in position to the LEDs 12 fitted on the fitting seat 11.

The color of the light emitted from the conventional lamp 1 may be altered by changing the color of the LEDs 12 or the lenses 13. Similarly, the light field projected by the conventional lamp 1 may also be altered by changing the shapes and structures of the lenses 13. Users can select the lamps 1 according to the demands of different occasions.

These demands, however, are restricted by the specification of the products, which is established even before manufacture. While manufacturers may, to a certain extent, alleviate this concern by providing a wide variety of lamps having LEDs 12 and lenses 13 in different colors and shapes for consumers to choose from, the amount of time and resources spent in preparation and assembly in order to offer such level of customization may turn out to be anything but worthwhile, requiring myriad combinations of LEDs 12 and lenses 13 or even add-ons such as color filters or diffusion lenses. Further down the line, should the color or shape of the emitted light from a purchased product fail to achieve a consumer's desired lighting effect, the consumer is left with no other option but to purchase another such product that provides an effect closer to the consumer's needs.

SUMMARY

Therefore, the object of the present invention is to provide a lamp with a detachable decorating unit that can alleviate at least one of the aforesaid drawbacks of the prior art.

Accordingly, a lamp of this invention includes a base, a light emitting module mounted to the base, a lens member and a decorating unit. The lens member has a light input surface, a light output surface disposed in front of and spaced apart from the light input surface along an axis, and a through hole extending through the light input surface and the light output surface. Light emitted from the light emitting module enters the lens member through the light input surface and exits the lens member through the light output surface. The decorating unit is detachable and is optically disposed for decorating the lamp or for changing at least one of a wavelength, an output angle and a light field and so forth of the light passing through the lens member.

BRIEF DESCRIPTION OF THE DRAWINGS

Other features and advantages of the present invention will become apparent in the following detailed description of the embodiments with reference to the accompanying drawings, of which.

DETAILED DESCRIPTION

Figure 1:
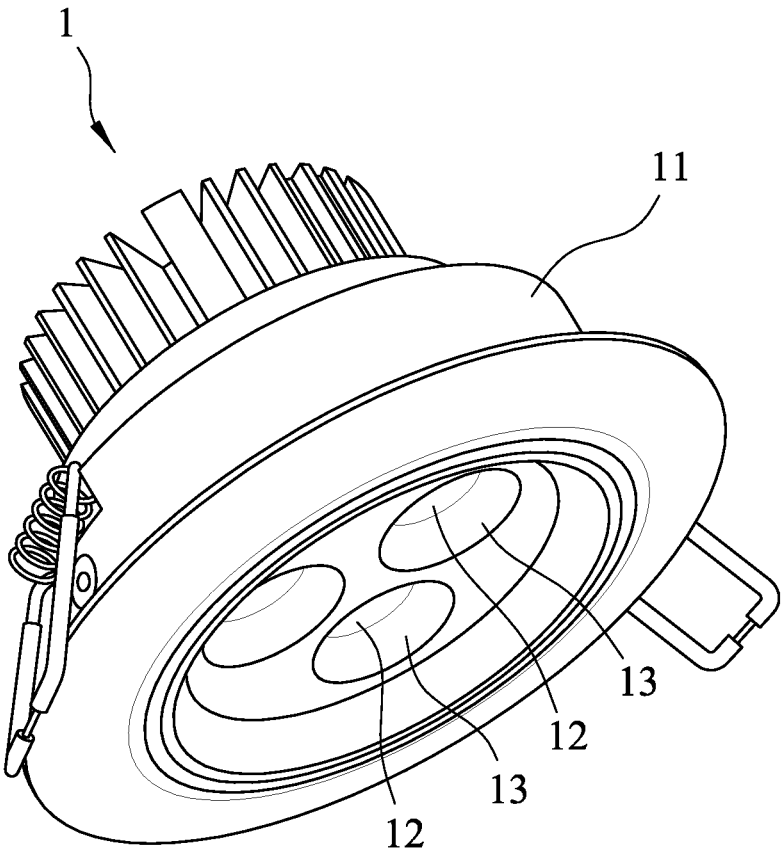
FIG.1 PRIOR ART
FIG. 1 is an assembled perspective view of a conventional lamp.

Before the present invention is described in greater detail, it should be noted that like elements are denoted by the same reference numerals throughout the disclosure.

Figure 2:
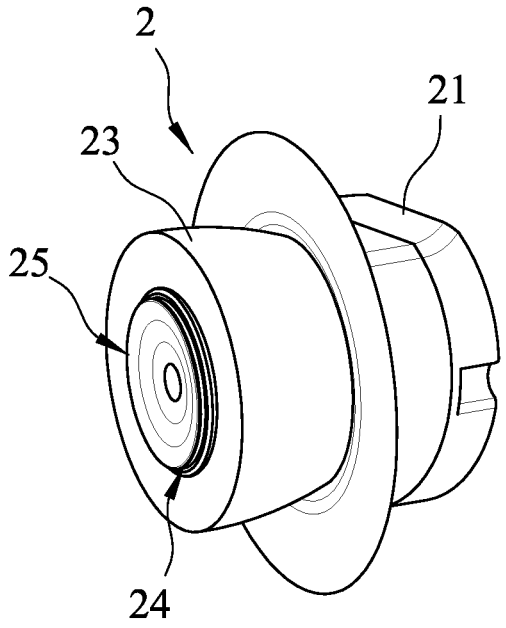
FIG. 2 is an assembled perspective view of a first embodiment of a lamp according to the present invention.
Figure 3:
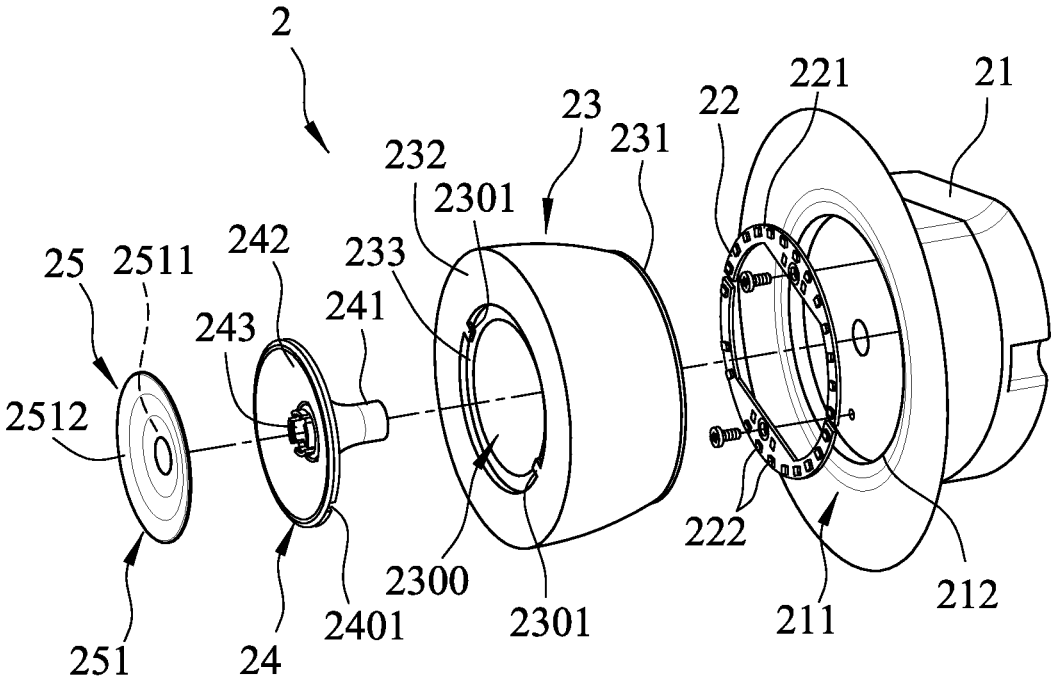
FIG. 3 is an exploded perspective view of the first embodiment.

Referring to FIGS. 2 and 3, the first embodiment of a lamp 2 according to the present invention includes a base 21, a light emitting module 22 mounted to the base 21, a lens member 23, a securing unit 24, and a decorating unit 25.

The base 21 has a connecting surface 211 that faces the light emitting module 22 and that has an engaging portion 212 engaging the lens member 23.

Figure 10:
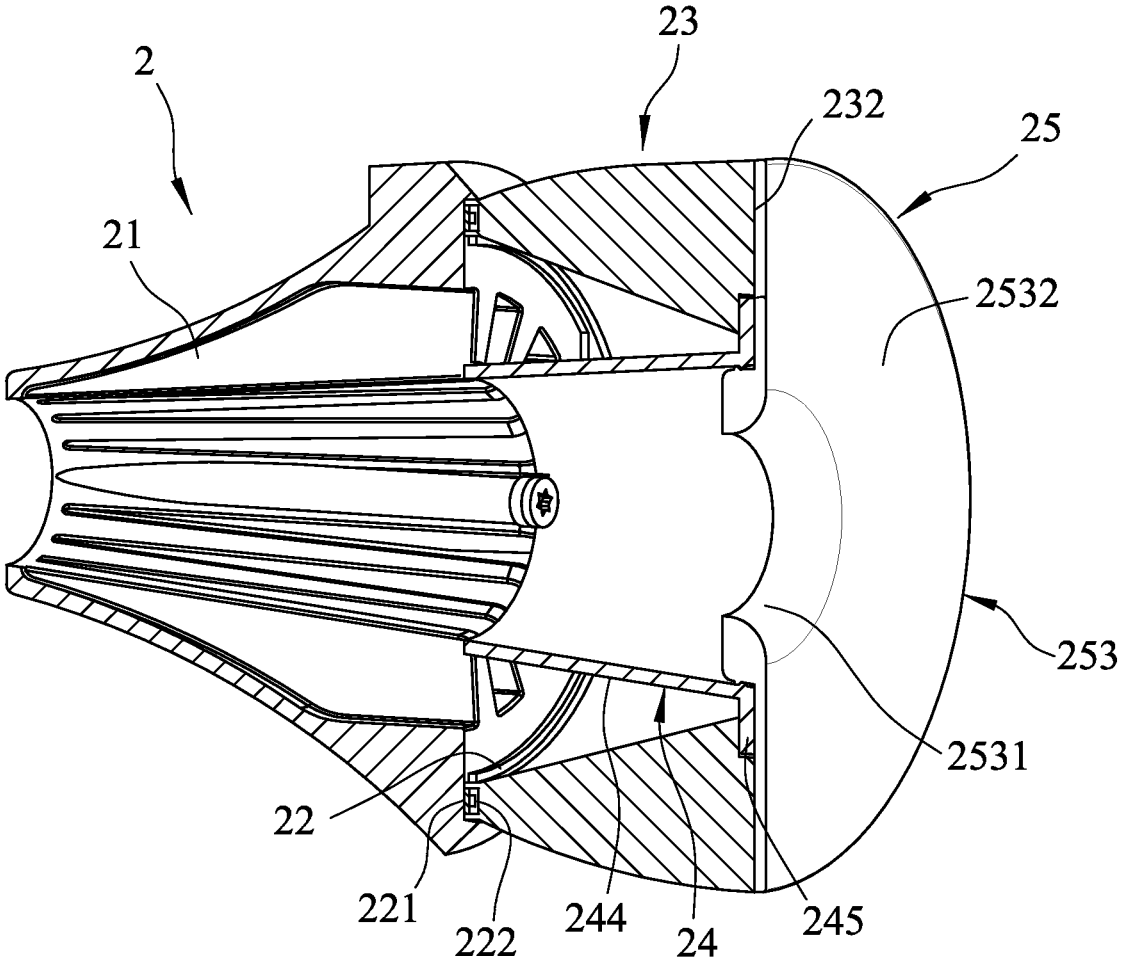
FIG. 10 is a schematic sectional view of the second embodiment.

The light emitting module 22 includes a printed circuit board (PCB) 221 connected to the connecting surface 211, and a plurality of LEDs 222 mounted on the PCB 221 (see FIG. 10).

The lens member 23 has a light input surface 231 engaged with the engaging portion 212 of the connecting surface 211 of the base 21, a light output surface 232 disposed in front of and spaced apart from the light input surface 231 along an axis, and a through hole 2300 extending through the light input surface 231 and the light output surface 232. As such, light emitted from the light emitting module 22 enters the lens member 23 through the light input surface 231 and exits the lens member 23 through the light output surface 232. The light output surface 232 is larger than the light input surface 231.

The securing unit 24 has a securing portion 241 passing through the through hole 2300 of the lens member 23 and connected fixedly to the base 21 so that the lens member 23 is located between the securing unit 24 and the base 21, a disk-shaped abutment portion 242 abutting against a front end of the lens member 23 and connected to the securing portion 241, and a coupling portion 243 arranged on the abutment portion 242. Specifically, the coupling portion 243 extends forwardly from the center of the abutment portion 242. The lens member 23 and the securing unit 24 are provided respectively with first and second engaging components 2301, 2401, and are connected to each other through engagement between the first and second engaging components 2301, 2401. In this embodiment, the light output surface 232 of the lens member 23 has a stepped receiving portion 233 formed as a recess for receiving a peripheral part of the abutment portion 242 of the securing unit 24.

Figure 4:
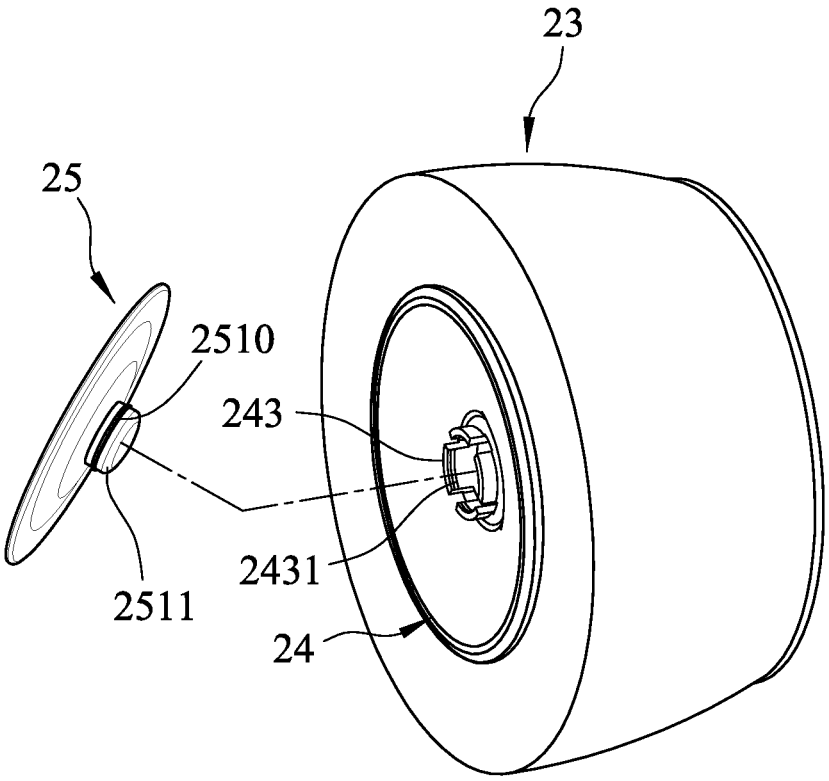
FIG. 4 is an exploded perspective view of a first decorating member and a securing unit of the first embodiment.
Figure 5:
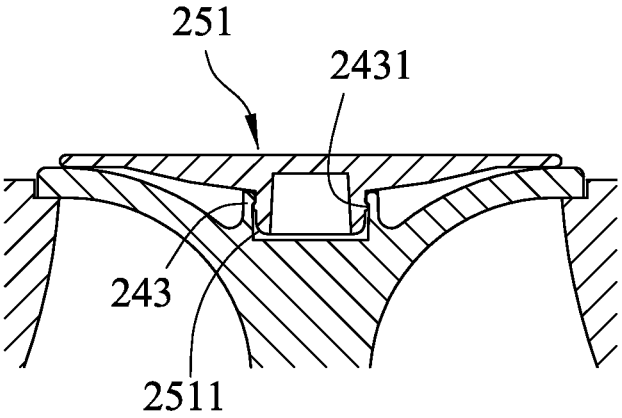
FIG. 5 is a fragmentary schematic sectional view of the first decorating member and the securing unit.
Figure 6:
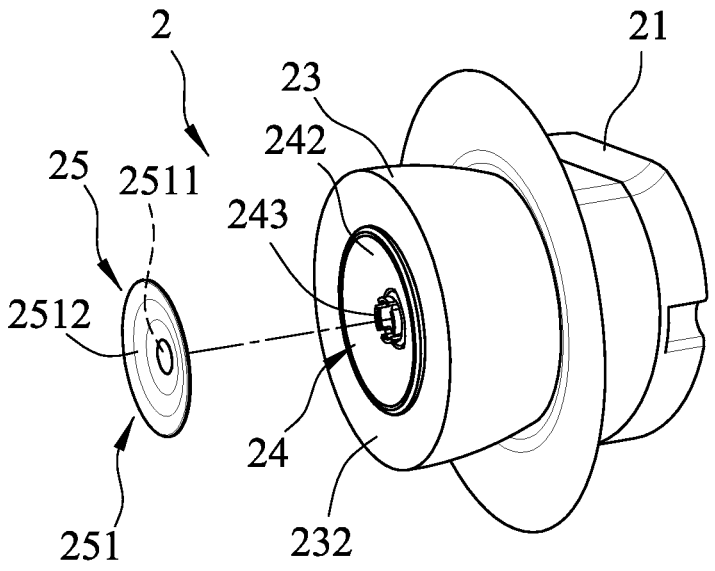
FIGS. 6 to 8 are partly exploded perspective views of the first embodiment with different decorating members.

Referring further to FIGS. 4 to 6, the decorating unit 25 is disposed within the light output surface 232 of the lens member 23 for decorating the lamp 2 or optically disposed for changing at least one of a wavelength, an output angle and a light field and so forth of the light passing through the lens member 23. The decorating unit 25 has a first decorating member 251, which has a first connecting section 2511 that is detachably connected to the coupling portion 243 of the securing unit 24, and a first decorating section 2512 that is connected to the first connecting section 2511 at an end opposite to the coupling portion 243 of the securing unit 24, and that does not cover the light output surface 232 of the lens member 23 such that the first decorating section 2512 is simply for decorating the lamp. As illustrated in FIGS. 4 and 5, the coupling portion 243 of the securing unit 24 in this embodiment has an annular wall surrounding the axis, defining a securing space therein, and formed with a plurality of angularly-spaced apart notches that extend parallel to the axis and an annular securing groove 2431 that surrounds the axis at the inner side of the coupling portion 243. The first connecting section 2511 of the decorating unit 25 in this embodiment has a block inserted into the securing space and formed with an annular external protrusion 2510 that engages the annular securing groove 2431. During the process of the engagement between the first connecting section 2511 of the first decorating member 251 and the coupling portion 243 of the securing unit 24, the annular wall of the coupling portion 243, due to the presence of the notches, is radially and outwardly deformed by the annular external protrusion 2510 when the annular external protrusion 2510 is moved along the axis until the annular external protrusion 2510 is slipped into the annular securing groove 2431. In other embodiments of this invention, the method of connecting the securing unit and the decorating unit is not limited to the disclosure herein.

Figure 7:
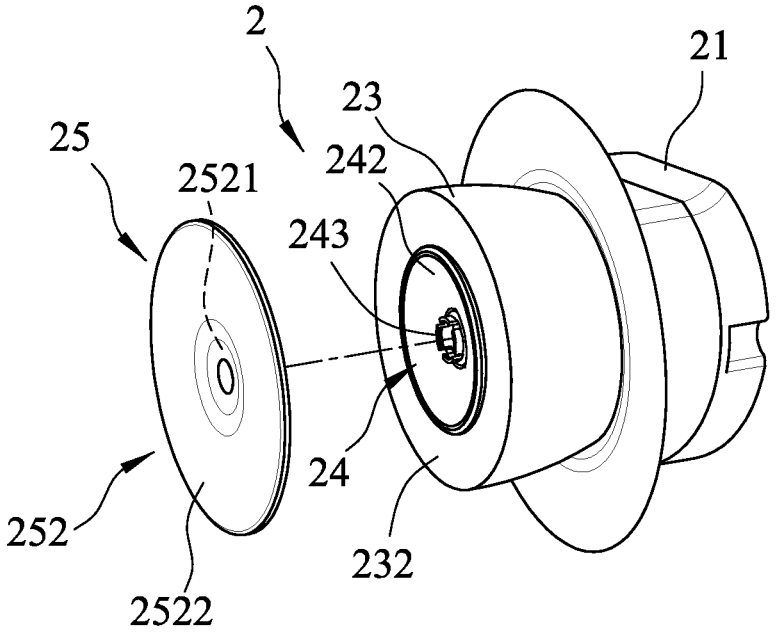
Figure 8:
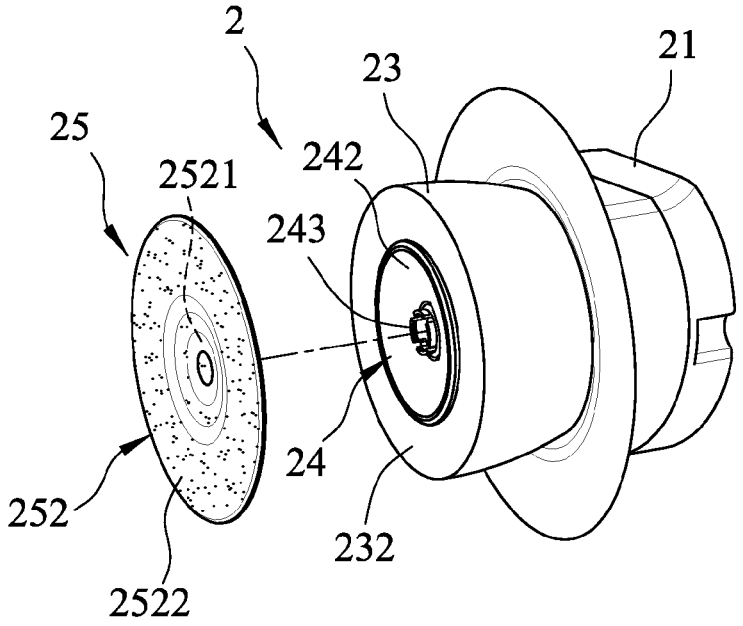

Referring to FIG. 7, the decorating unit 25 has a second decorating member 252, which can be interchanged with the first decorating member 251 according to the needs of different occasions. The second decorating member 252 has a second connecting section 2521 that is detachably connected to the coupling portion 243 of the securing unit 24 in the same manner as the coupling of the first connecting section 2511 of the first decorating member 251 to the coupling portion 243 of the securing unit 24, and a second decorating section 2522 that is connected to the second connecting section 2521 at an end opposite to the coupling portion 243 of the securing unit 24. The second decorating section 2522 is larger in area than the first decorating section 2512 of the first decorating member 251, thereby covering the light output surface 232 of the lens member 23; namely, the decorating unit 25 is optically disposed to the lens member 23 so that the characteristics of the light emitted by the light output surface 232 is changeable by virtue thereof. The second decorating section 2522 may be configured as a color filter for changing the light color or have an outer surface formed with a plurality of microstructures (see FIG. 8) for changing the light field and so forth of the light passing through the lens member 23. The microstructures may be configured as dots or rough structures, wherein they can be used to diffuse or focus the light emitted from the light output surface 232; or configured as prisms or elongated type structures such as V-cut structures or R-cut structures, wherein they can be used to bring on uniform distribution of the light field of the light emitted from the light output surface 232.

Figure 9:
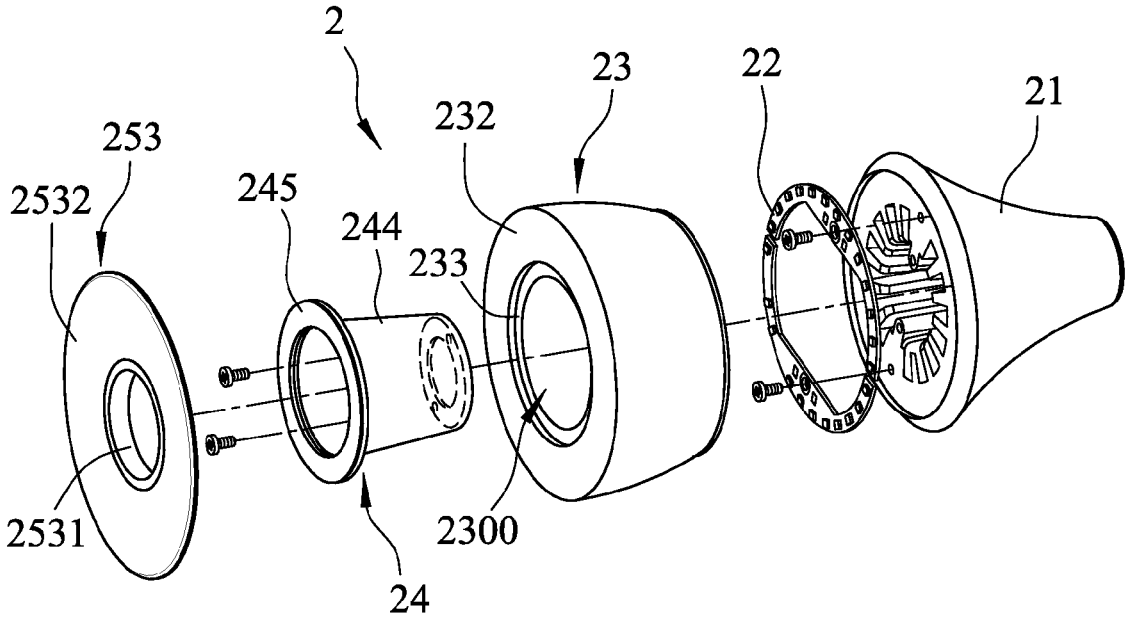
FIG. 9 is an exploded perspective view of a second embodiment of a lamp according to the present invention.

With reference to FIGS. 9 and 10, the second embodiment of the lamp 2 according to the present invention is similar to the first embodiment, except for the configurations of the securing unit 24 and the decorating unit 25. In this embodiment, the securing unit 24 includes a securing tube 244 passing through the through hole 2300 of the lens member 23 and connected fixedly to the base 21, and an annular abutment portion 245 abutting against the front end of the lens member 23, connected to the securing tube 244 at an end opposite to the base 21 and having the decorating unit 25 detachably connected thereto. The abutment portion 245 is received in the receiving portion 233 of the lens member 23.

The decorating unit 25 in this embodiment further can be replaced by a third decorating member 253, which includes a third connecting section 2531 that is detachably connected to the annular abutment portion 245, and a ring-shaped third decorating section 2532 that is connected to the third connecting section 2531 at an end opposite to the annular abutment portion 245, and that covers the light output surface 232 of the lens member 23. The third connecting section 2531 is tubular and slightly smaller in diameter than the securing tube 244, so that it can insert into the securing tube 244 and be secured onto an inner surface of the securing tube 244. The abovementioned configurations increase heat-dissipating efficiency of the lamp 2 by allowing air from the external environment to pass through the securing unit 24 and the decorating unit 25. The third decorating section 2532 may also be configured as a color filter or have an outer surface formed with a plurality of microstructures for changing the wavelength or angle or light field of the light passing through the lens member 23.

Figure 11:
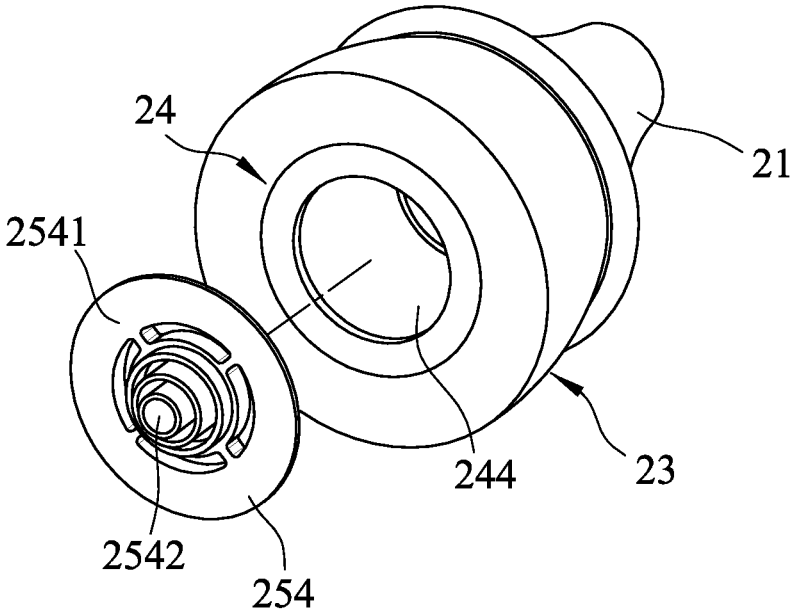
FIG. 11 is a partly exploded perspective view of the second embodiment with a different decorating member.

In another configuration of this embodiment, as illustrated in FIG. 11, the decorating unit 25 further can be replaced by a fourth decorating member 254 having a fourth decorating section 2541 that is detachably connected to a front end of the lens member 23, and an auxiliary section 2542 that is connected to and surrounded by the fourth decorating section 2541. The auxiliary section 2542 can be designed to have different decorating patterns and formed with a plurality of air holes to allow passage of air therethrough.

Figure 12:
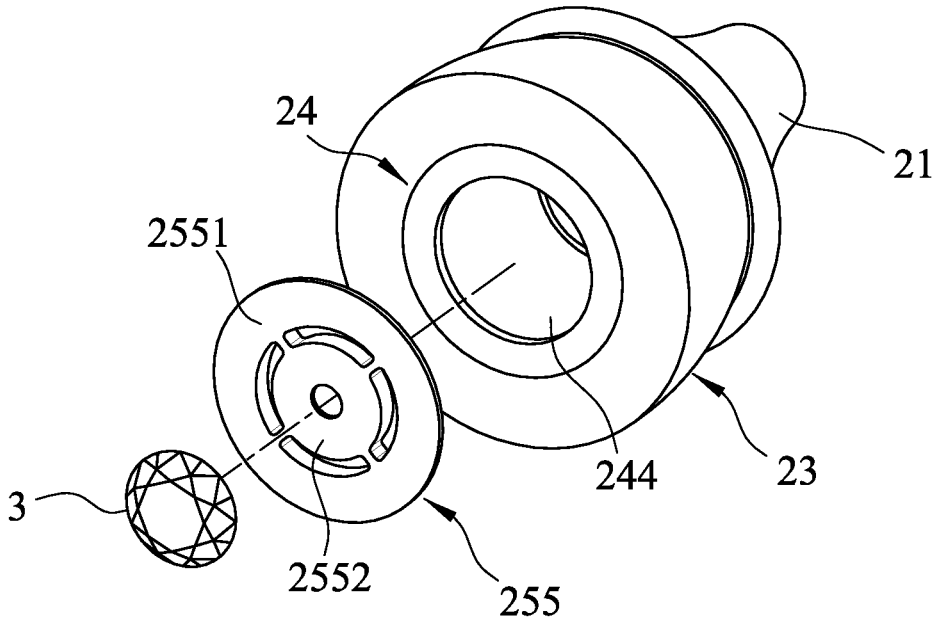
FIG. 12 is a partly exploded perspective view of the second embodiment with another different decorating member.

In yet another configuration of this embodiment, as illustrated in FIG. 12, the decorating unit 25 can further be replaced by a fifth decorating member 255 having a fifth decorating section 2551 that is detachably connected to a front end of the lens member 23, and an auxiliary section 2552 that is connected to and surrounded by the fifth decorating section 2551. The lamp 2 herein further comprises an ornament 3 connected detachably to the auxiliary section 2552. The decoration style may be multiform by changing the design of the ornament 3.

Figure 13:
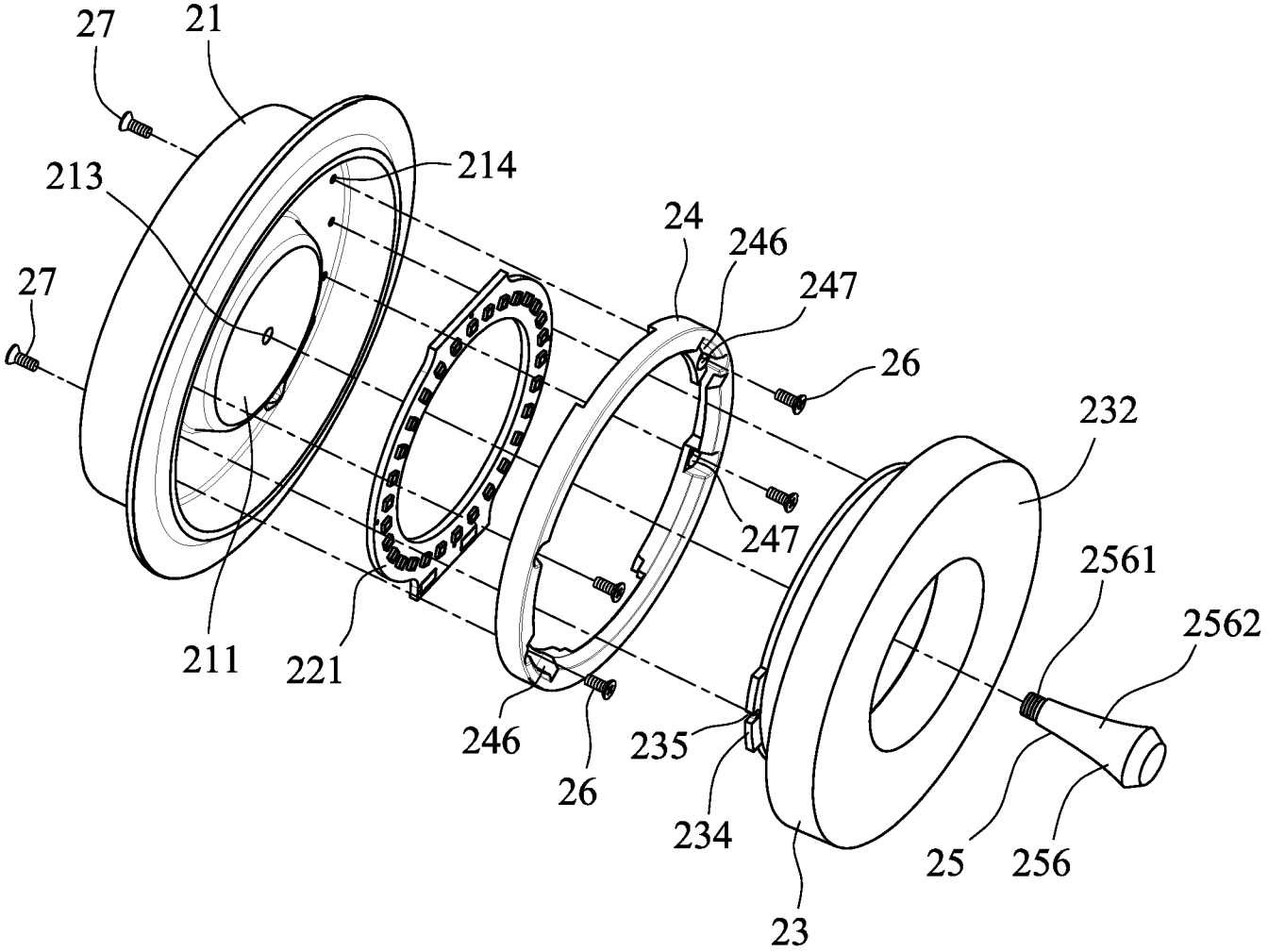
FIG. 13 is an exploded perspective view of the third embodiment of a lamp according to the present invention.
Figure 14:
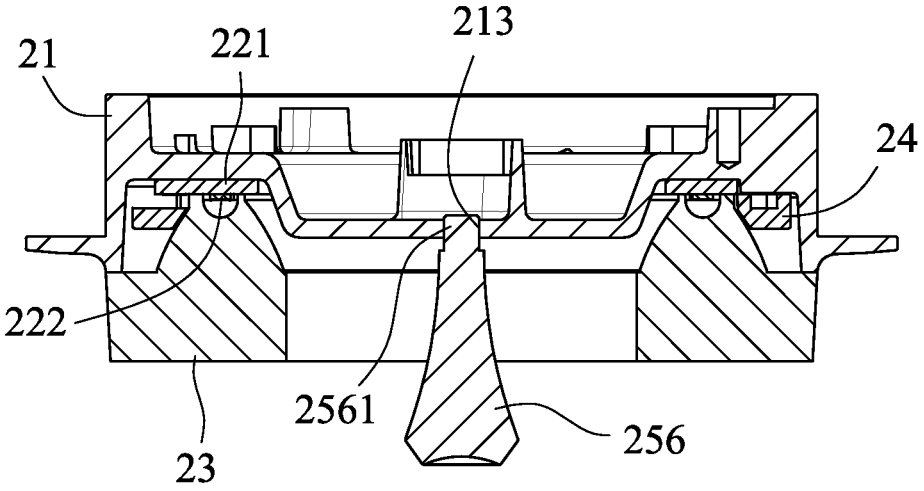
FIG. 14 is a schematic sectional view of the third embodiment.

Referring to FIGS. 13 and 14, the third embodiment of the lamp 2 according to the present invention is similar to the first and second embodiments, except for the structures and configurations of the base 21, the securing unit 24 and the decorating unit 25. In this embodiment, the securing unit 24 is ring-shaped, is disposed in the base 21 and interposed between the PCB 221 and the lens member 23, and has two L-shaped grooves 246 formed on a side facing the lens member 23, and four angularly spaced-apart threaded through holes 247. Two of the through holes 247 are formed in the grooves 246.

The base 21 of this embodiment includes four screw holes 214. Four front screws 26 are provided to be inserted respectively and threadedly through the through holes 247 to engage respectively and threadedly the screw holes 214 so as to firmly fix the securing unit 24 to the base 21.

Figure 15:
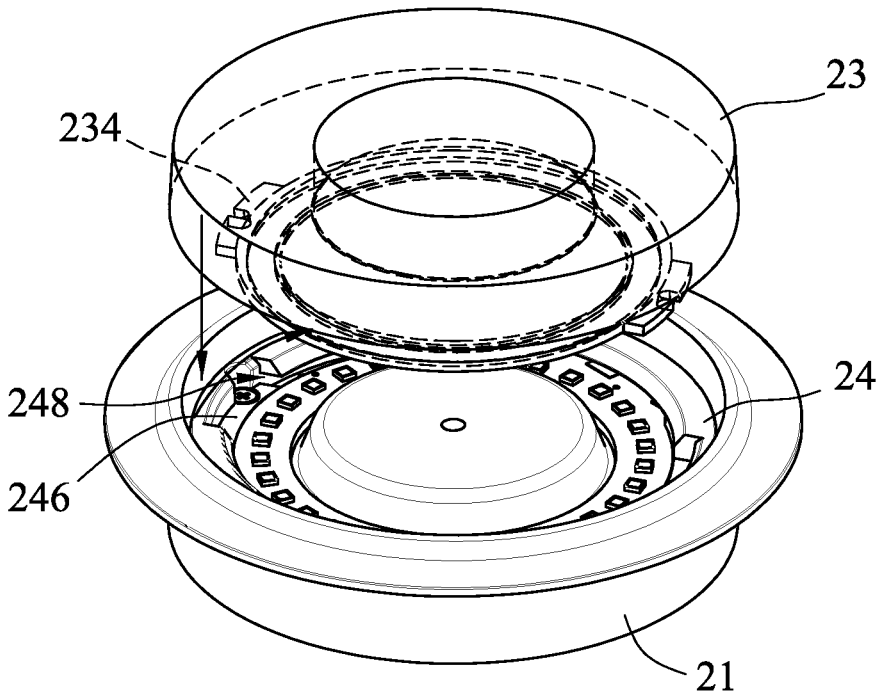
FIG. 15 is a fragmentary exploded perspective view of the third embodiment illustrating how a lens member is secured to a base.

The lens member 23 further includes two protrusions 234 (only one is visible) that respectively engage the grooves 246. During assembly of the lens member 23 and the securing unit 24, the protrusions 234 of the lens member 23 are first inserted respectively into the grooves 246 of the securing unit 24, and the lens member 23 is rotated relative to the securing unit 24 to be locked to the securing unit 24. Each of the protrusions 234 is formed with a lock hole 235. Two rear screws 27 are provided to extend through the base 21 and the securing unit 24 and engage respectively with the lock holes 235 so as to prevent rotation of the lens member 23 relative to the base unit 21. Particularly, as illustrated by FIG. 15, the lens member 23 is moved toward the securing unit 24 until the protrusions 234 respectively enter the grooves 246, and is then rotated relative to the securing unit 24 to respectively enter spaces 248 (only one is shown) which are respectively next to the grooves 246 and which extend between the securing unit 24 and the base 21 to finish the assembly of the lens member 23 and the securing unit 24.

The decorating unit 25 has a sixth decorating member 256 having a sixth decorating section 2562 extending through the lens member 23 and the securing unit 24, and a sixth connecting section 2561 connected detachably to the base 21. The decorating unit 25 may be received in a threaded hole 213 defined by the connecting surface 211 of the base 21 by threaded engagement between the sixth connecting section 2561 and the threaded hole 213 (see FIG. 13), or the sixth connecting section 2561 may be configured to be connected detachably to the base 21 by being hooked on the connecting surface 211 of base 21. The sixth decorating section 2562 does not cover the light output surface 232. Similarly, the first to sixth decorating members 251, 252, 253, 254, 255, 256 can be interchanged according to practical requirements.

In sum, the lamp 2 not only allows a user to detach and replace, for example, the first, fourth, fifth, and sixth decorating members 251, 254, 255, 256 to suit their decorative needs, but also lets the user detach and replace, for example, the second and third decorating members 252, 253, which further provides a wide variety of customization options in terms of color, light field, etc. to achieve the user's desired lighting effects.

While the present invention has been described in connection with what are considered the exemplary embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A lamp comprising:

a base;

a light emitting module mounted to said base;

a lens member having a light input surface, a light output surface disposed in front of, parallel to, and spaced apart from said light input surface along an axis, and a through hole extending through said light input surface and said light output surface, light emitted from said light emitting module entering said lens member through said light input surface and exiting said lens member through said light output surface; and a detachable decorating unit;

wherein said light output surface of said lens member is larger than said light input surface of said lens member.

2. The lamp as claimed in claim 1, wherein said base has a connecting surface that faces said light emitting module and that has an engaging portion engaged with said lens member.

3. The lamp as claimed in claim 1, further comprising a securing unit passing through said through hole of said lens member and connected fixedly to said base so that the lens member is located between the securing unit and the base, said decorating unit being detachably connected to said securing unit.

4. The lamp as claimed in claim 3, wherein said securing unit has:

a securing portion passing through said through hole of said lens member and connected fixedly to said base;

an abutment portion abutting against a front end of said lens member, and connected to said securing portion; and a coupling portion arranged on said abutment portion, said decorating unit being detachably installed on the coupling portion of said securing unit.

5. The lamp as claimed in claim 4, wherein said lens member and said securing unit are provided respectively with first and second engaging components, and are connected to each other through engagement between said first and second engaging components.

6. The lamp as claimed in claim 5, wherein said light output surface of said lens member has a receiving portion, said abutment portion of said securing unit being received in said receiving portion.

7. The lamp as claimed in claim 4, wherein said decorating unit includes a decorating member having:

a connecting section that is detachably connected to said coupling portion of said securing unit, and a decorating section that is connected to said connecting section at an end opposite to said coupling portion of said securing unit, and that does not cover said light output surface of said lens member.

8. The lamp as claimed in claim 7, wherein:

said coupling portion of said securing unit has an annular wall defining a securing space therein and formed with an annular securing groove; and said connecting section of said decorating unit has a block inserted into said securing space and formed with an annular external protrusion that engages said annular securing groove.

9. The lamp as claimed in claim 4, wherein said decorating unit includes a decorating member having:

a connecting section that is detachably connected to said coupling portion of said securing unit, and a decorating section that is connected to said connecting section at an end opposite to said coupling portion of said securing unit, and that covers said light output surface of said lens member.

10. The lamp as claimed in claim 9, wherein:

said coupling portion of said securing unit has an annular wall defining a securing space therein and formed with an annular securing groove; and said connecting section of said decorating unit has a block inserted into said securing space and formed with an annular external protrusion that engages said annular securing groove.

11. The lamp as claimed in claim 9, wherein said decorating section of said decorating member is configured as a color filter.

12. The lamp as claimed in claim 9, wherein said decorating section of said decorating member has an outer surface formed with a plurality of microstructures.

13. The lamp as claimed in claim 3, wherein said securing unit has:

a securing tube passing through said through hole of said lens member and connected fixedly to said base; and an annular abutment portion abutting against the front end of said lens member, and connected to said securing tube at an end opposite to the base, said decorating unit being detachably connected to said abutment portion of said securing unit.

14. The lamp as claimed in claim 13, wherein said light output surface of said lens member has a receiving portion, said abutment portion of said securing unit being received in said receiving portion.

15. The lamp as claimed in claim 13, wherein said decorating unit includes a decorating member having:

a connecting section that is detachably connected to said abutment portion of said securing unit, and a decorating section that is connected to said connecting section at an end opposite to said abutment portion of said securing unit.

16. The lamp as claimed in claim 15, wherein said decorating section of said decorating member is ring-shaped and covers said light output surface of said lens member.

17. The lamp as claimed in claim 15, wherein said decorating section of said decorating member is configured as a color filter.

18. The lamp as claimed in claim 15, wherein said decorating section of said decorating member has an outer surface formed with a plurality of microstructures.

19. The lamp as claimed in claim 1, wherein said decorating unit includes a decorating member having a decorating section that is detachably connected to a front end of said lens member, and an auxiliary section that is connected to said decorating section.

20. The lamp as claimed in claim 1, wherein said decorating unit includes a decorating member having:

a decorating section that is detachably connected to a front end of said lens member; and an auxiliary section that is connected to said decorating section, said lamp further comprising an ornament connected to said auxiliary section.

21. The lamp as claimed in claim 1, further comprising a securing unit interposed between said base and said lens member for coupling said lens member to said base.

22. The lamp as claimed in claim 21, wherein said decorating unit extends through said lens member and said securing unit and is detachably connected to said base.

23. The lamp as claimed in claim 1, wherein said decorating unit is disposed for changing the color, wavelength, angle or light field of the light emitted from said light output surface of said lens member.

24. The lamp as claimed in claim 1, wherein said lamp comprises at least two of said decorating units that are interchangeable.

25. The lamp as claimed in claim 1, wherein:

said lens member further has a groove located in said light input surface and defined by a curved surface;

a first opening surrounded by said light input surface is larger than a second opening surrounded by said light output surface; and said light emitting module is disposed within said groove and facing said curved surface.

26. The lamp as claimed in claim 1, wherein:

said light input surface and said light output surface are ring-shaped surfaces;

said lens member further has a groove located in the light input surface and defined by a curved surface, an outer surrounding surface interconnecting outer peripheries of said light input surface and said light output surface, and diverging from said light input surface to said light output surface, and an inner surrounding surface interconnecting inner peripheries of said light input surface and said light output surface, and converging from said light input surface to said light output surface; and said light emitting module is disposed within said groove and facing said curved surface.

* * * * *